US005636751A

United States Patent [19]

Frank

[11] Patent Number: 5,636,751

[45] Date of Patent: Jun. 10, 1997

[54] COMBINATION RACK FOR STORING MEN'S AND WOMEN'S SHOES

[76] Inventor: Monty R. Frank, 4528 Russo Dr., San Jose, Calif. 95134

[21] Appl. No.: 323,669

[22] Filed: Oct. 17, 1994

[51] Int. Cl.[6] ..... A47F 7/08

[52] U.S. Cl. ..... 211/36; 211/163; 211/194

[58] Field of Search ..... 211/34–38, 194, 211/188, 163, 189, 196; 229/120.33, 120.32

[56] References Cited

U.S. PATENT DOCUMENTS

| | | | |
|---|---|---|---|
| 1,231,713 | 7/1917 | Cummings | 211/38 |
| 1,724,386 | 8/1929 | Weston | 211/34 |
| 2,679,348 | 5/1954 | Tichenor | 229/120.33 |
| 3,478,890 | 11/1969 | Allsop | 211/37 |
| 3,539,052 | 11/1970 | Bellock | 211/37 |
| 4,981,224 | 1/1991 | Rushing | 211/126 |
| 5,172,816 | 12/1992 | Kline et al. | 211/37 |

*Primary Examiner*—Karen J. Chotkowski
*Assistant Examiner*—Gwendolyn Wrenn
*Attorney, Agent, or Firm*—Robert Samuel Smith

[57] ABSTRACT

A shelf rack such as for storing both men's and womn's shoes including a stack of shelf angles, a shelf angle being a pair of rectangular panels joined along a common edge and each shelf angle having a pair of bar members adapted for hanging shoes with high heels on side edges of the shelf angle. In one embodiment, the rack is structure of wooden panels and rods. The panels are hinged to fold together against a central panel for storage. In another embodiment, the rack is heat formed from a blank plastic panel. The heat formed panels may be stacked for convenient storage.

17 Claims, 3 Drawing Sheets

COMBINATION RACK FOR STORING MEN'S AND WOMEN'S SHOES

BACKGROUND

PRIOR ART AND INFORMATION DISCLOSURE

The typical shoe rack for storing men's and women's shoes in the home is a rack that is laid out on a closet floor and permits storage of the shoes as single rows. An important problem for couples living in cramped living quarters such as studio apartments is efficient use of space available for storing clothes, particularly shoes. The shoe racks that are commonly used often occupy a large amount of floor space in the closet or the corner of the room or under the bed. The occupants in some homes simply deposit their shoes on the closet floor in a disorderly array. The job of selecting or finding the appropriate shoes is tedious and irksome, especially when the man and women of the house are required to keep their shoes in the same closet or area.

U.S. Pat. No. 3,539,052 to Beelock discloses a rack of forms wherein a shoe slips over each form. The rack of this invention occupies appreciably more floor space for a given capacity than the rack of the present invention. The fixed shoe forms attachable to the stand accommodates only a limited range of shoe sizes.

U.S. Pat. No. 3,478,890 to Allsop discloses a shoe rack including an expandable frame for each shoe and mounted on a lazy suzan. The arrangement of this construction does make optimum use of space for the rack compared to the rack of the present invneion.

U.S. Pat. No. 4,981,224 to Rushing discloses a stacking tray display in which each tray is supported on a lowering neighboring tray by four tube legs The construction of this invention enabling the user to stack racks is more expensive than the rack of the present invention.

U.S. Pat. No. 5,172,816 to Kline discloses a pair of tubes for supporting shoes and a support that permits distance between the tubes to accommodate various shoe sizes. The adjustment does not provide for simultaneously storing a range of shoe sizes nor does it accommodate variations in style such as the differences between men's and women's shoes.

Styles of men's shoes having broad flat heels are distinctly different from styles of women's shoes which have narrow high heels. None of the disclosures presented above take advantage of these differences to optimize use of the space required for storing both kinds of shoes together.

THE INVENTION

OBJECTS

It is an object of this invention to provide a shoe rack that can fit into cramped quarters such as a corner of a room or a small closet.

It is another object that the rack can be used to store both men's or women's shoes.

It is another object that all of the shoes on the rack stored in cramped quarters be easily accessible.

It is another object that the rack have a modular construction wherein each module nests conveniently with other modules for convenient storage and can be quickly assembled together with a selected number of modules.

SUMMARY

This invention is directed toward a rotatable tree of a stack of shelves for storing men's shoes with bars for hanging women's shoes by the heels. Each shelf is a V shaped trough. The shelves are vertically stacked and horizontal bars are attached to each end of the trough.

In one embodiment, each trough comprises a pair of panels joined to a vertical central panel along a common line so that one panel of the trough is on one side of the central panel and the other panel is on the other side of the central panel.

The shelf panels are joined to the central panels by hinges and each bar comprises two bar sections, one end of each section hinged to an outside leg and the other ends of the bar sections hinged together so that the rack folds together for convenient storage or transportation.

The central panel has a handhole for lifting or turning the entire rack such as would be useful for temporarily withdrawing the rack from a cramped location in a closet in order to provide total access to all storage locations on the rack. Convenient access is also provided by the feature of being able to rotate the rack.

In another embodiment, each trough (shelf) is a thermoplastic panel bent along center line to form a "shelf angle". Each shelf angle has four legs, one leg at each corner of the shelf angle. Each leg is a strip cut from the panel attached at one end to the corner of the panel and bent down vertically from the respective corner of the shelf angle. The lower end of each leg of a shelf angle snaps onto a corner of a lower shelf angle. An elongated horizontal bar angle has one end attached to a leg on one coiner of the shelf angle and another end attached to an adjacent comer of the shelf angle. Each bar angle has one or more holes for hanging a woman's shoe by the heel.

DRAWINGS

Figure 3:
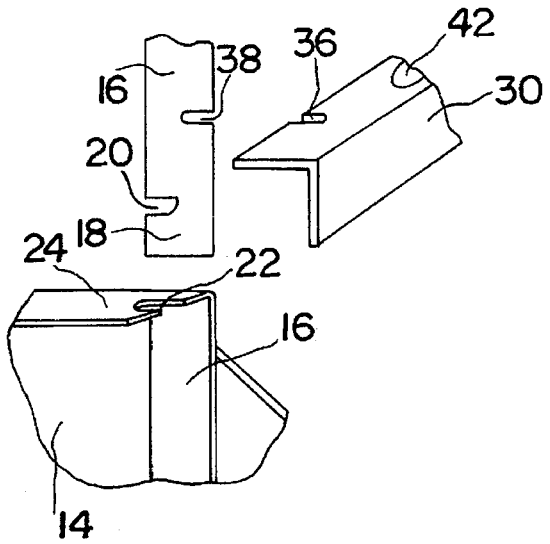

FIG. 3 an exploded view showing details of the leg support.

Figure 4:
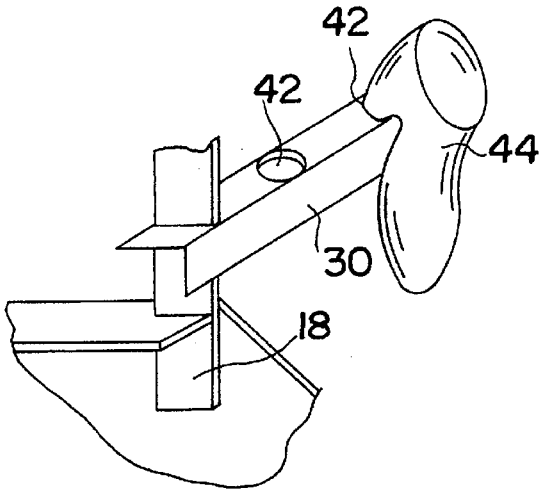

FIG. 4 an assembly view showing details of the leg support.

Figure 5:
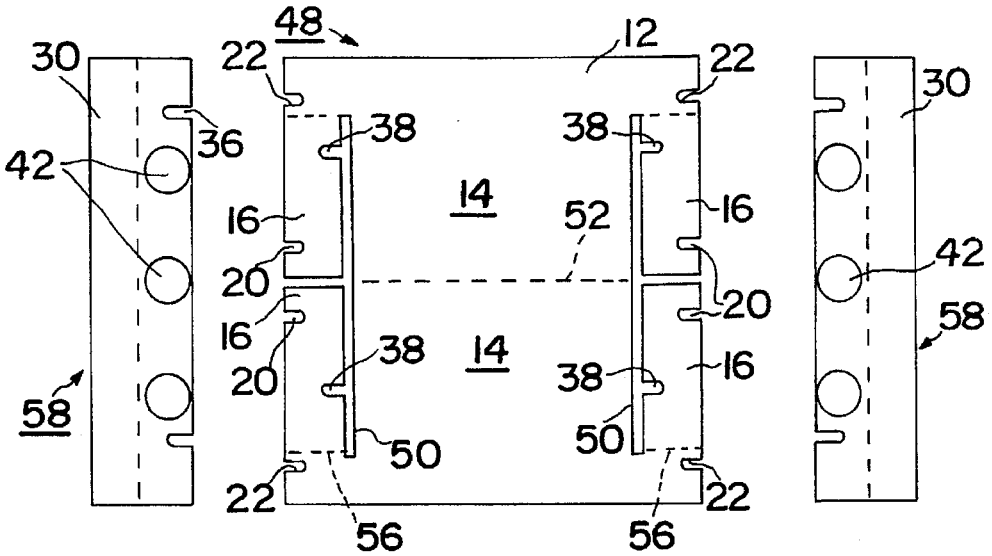

FIG. 5 shows a blank for forming a shelf angle.

Figure 1:
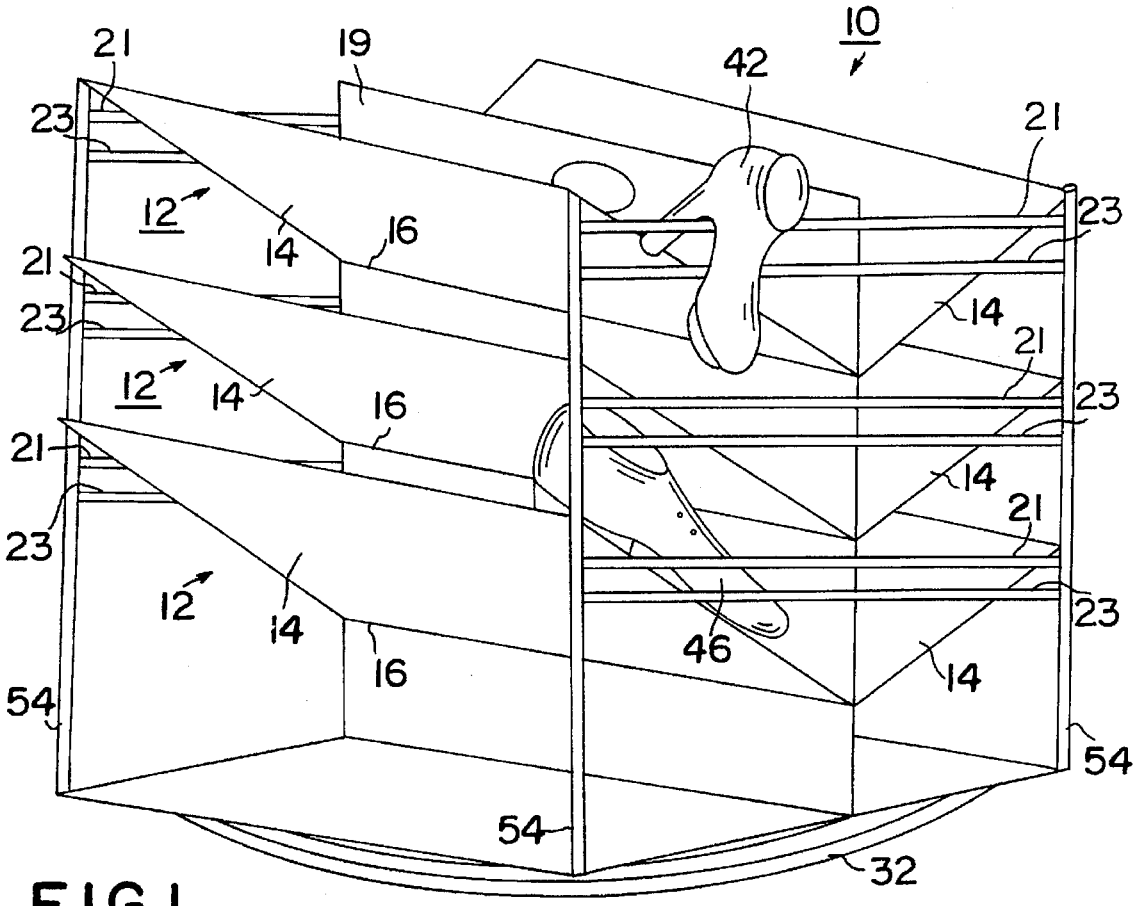
FIG. 1 shows an assembly view of one embodiment of the invention
Figure 6:
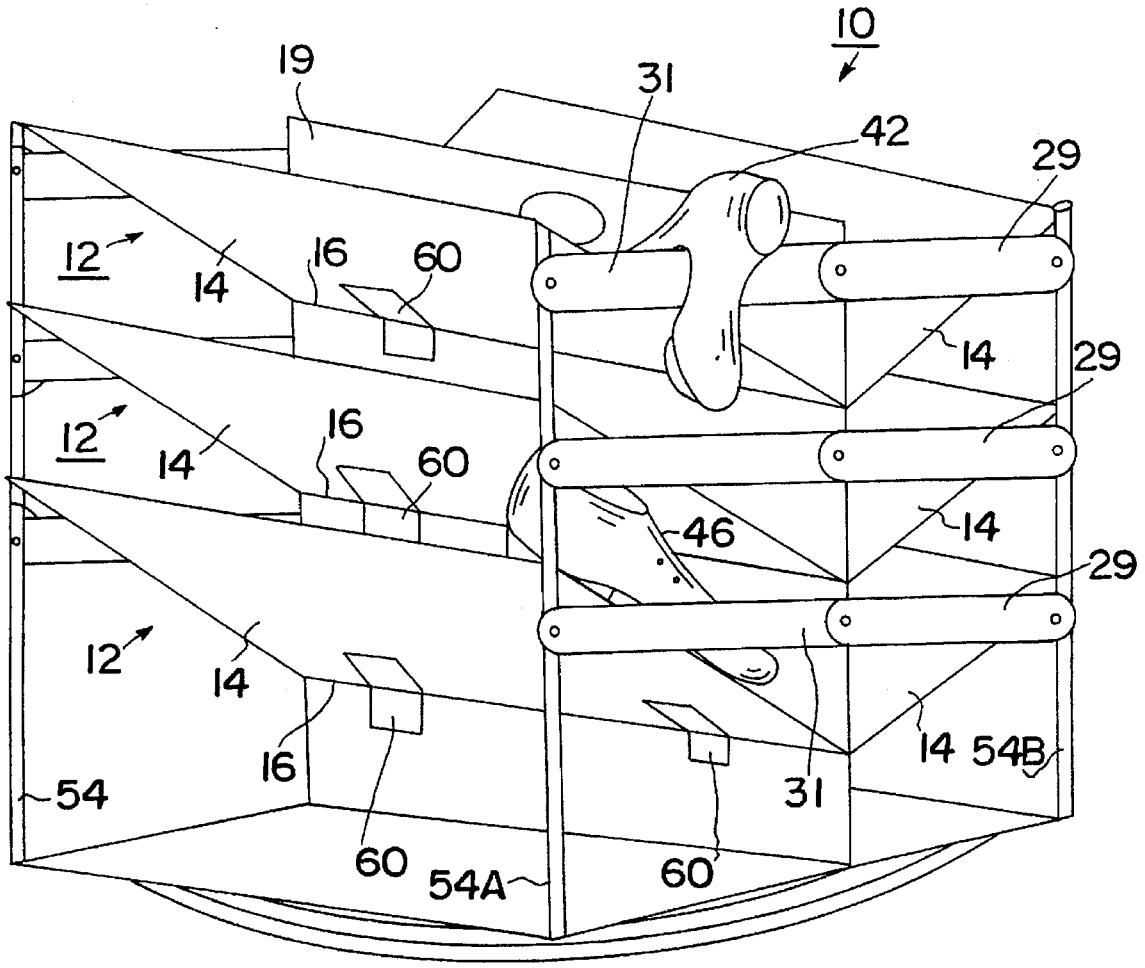

FIG. 6 shows a folding version of FIG. 1

Figure 7:
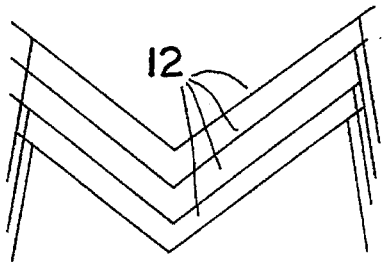

FIG. 7 show a stack of the shelves.

DESCRIPTION OF A BEST MODE

Turning now to a discussion of the drawings, FIG. 1 is an assembly view of one embodiment of the shoe rack 10 of this invention in perspective showing a vertical stack of shelves 12. Each shelf 12 includes a pair of rectangular elongated panels 14, each panel 14 having a lower edge 17 joined to a cental vertical panel 19 and also joined to an edge of the other panel of the pair. A pair of bars 21, 23 is attached horizontally to each end edge of each shelf angle 12. The lower end of the central panel 18 is supported on a lazy suzan 32, four vertical posts 54, one in each corner of the shelf angles are also positioned to support the vertical stack of shelves.

FIG. 6 shows a version of the rack of FIG. 1 in which the shelf panels are hinged to the central panel by hinges 60. Each bar 29 includes two bar sections 31, 33. Bar section 31 has one end hinged to an end of bar end 33 and another end to leg 54A and bar section 33 has another end hinged to leg 54B. This constructions permits folding the panels 14 and the bars toward the central panel 18 for convenient storage or transportation.

FIGS. 1 and 6 show a shoe 42 having a high heel with the heel hooked over bars 20, 22. A shoe 46 with a low heel is shown stored on the shelf 14.

Figure 2:
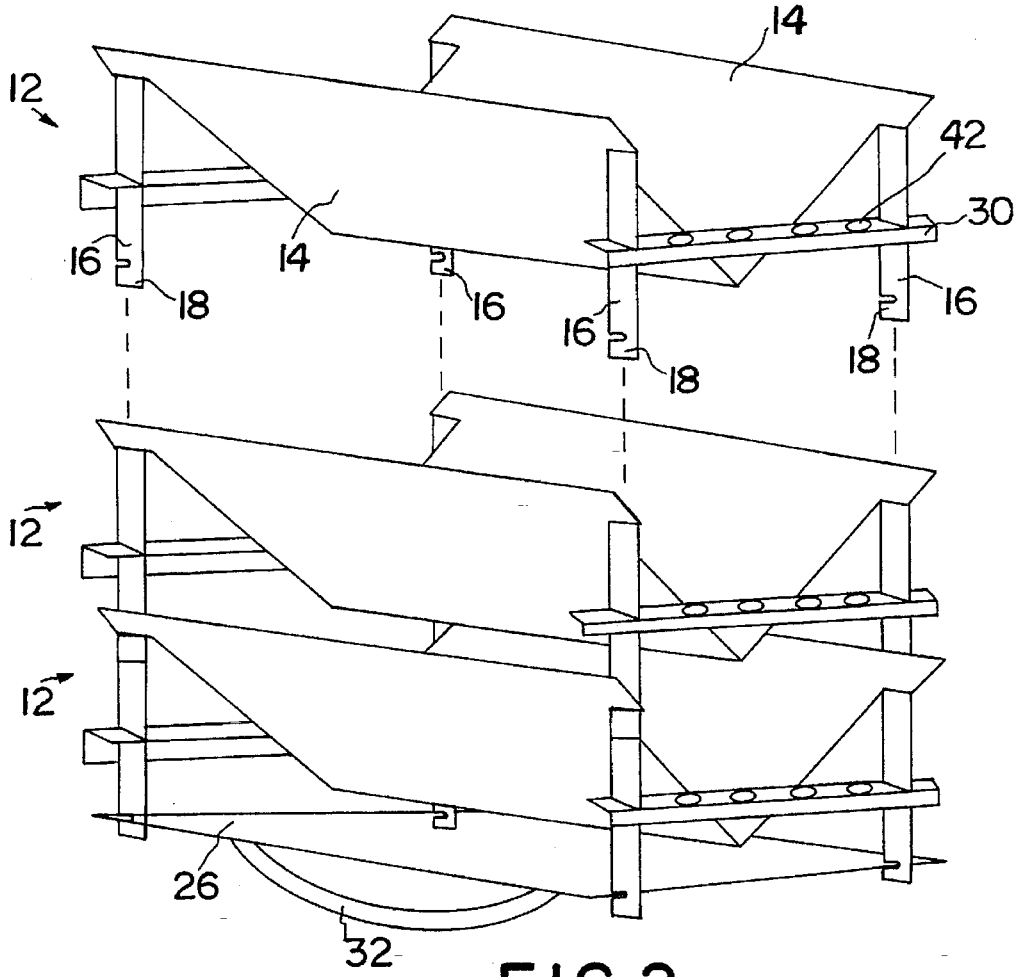
FIG. 2 shows another embodiment of the invention.

FIG. 2 shows a second embodiment of the invention wherein the rack comprises a stack of shelf angles 12. Two shelf angles 12 are shown assembled together and a third shelf angle 12 is shown detached from the bottom two shelf angles 12. Each shelf angle 12 is seen to include two panels 14 having four vertical legs 16.

As shown in greater detail in FIGS. 3 and 4, each corner 24 of the shelf angle 12 has a strip that is bent down to form a leg 16. The lower end 18 of each leg 16 has a notch 20 that snaps into a notch 22 in the respective comer 24 of a panel 14 of a lower shelf angle 12. The lower end of the lowest shelf angle 12 may be supported on the floor or it may snap onto a horizontal panel 26 that is mounted onto a lazy suzan 32.

A bar angle 30 has a slot 36 close to each end for snapping into a slot 38 on leg 16. Each bar angle 30 has one or more holes 42 for receiving the heel of a woman's shoe. FIG. 4 shows a shoe 44 with a high heel having the heel hooked in one of holes 42.

An advantage of the second embodiment is that both the shelf angle 12 and the bar angle 30 can be punched out of a thermoplastic panel in one operation and heat formed in a second operation. FIG. 5 shows a blank 48 punched from a rectangular panel according to the first step. Them are shown slots 50 that form the legs 16. Bend lines 56 for orienting the legs 16 are shown. Central bend line 52 which is the common edge of panels 14 is shown. The lower end of each leg has a slot 20 for engaging slot 22 in the lower shelf angle.

FIG. 5 also shows shows a blank 58 for forming the bar angle 30. Holes 42 for receiving the heels and notches 36 for engaging notches 38 in the legs of the lower shelf angle are shown.

FIG. 7 shows another advantage of the embodiment of FIG. 2 in that the dissembeled shelf angles may be stacked together for efficient use of storage space.

Variations and modifications of the construction of the rack of this invention may be considered which are within the scope of this invention.

For example, the bar angles may be omitted.

The angle between one shelf panel 14 and the other shelf panel 14 may have an arbitrary value depending on the circumstances of the intended use of the rack. In the examples shown in this specification, the angle is oblique.

Each leg may have an outside bend to form an angle to strengthen the leg.

The means for supporting the lower edge of the central support panels may be a horizontal floor panel or a lazy suzan.

As shown in FIG. 5 a plurality of notches 20 (two are shown in FIG. 5) may be formed in the outside edge of legs 16 so that the vertical distance between the shelves may be selected by selecting the notch 20 for engaging notch 22.

In view of this considerations, I therefore wish to define the scope of my invention by the appended claims.

I claim:

1. A rack for storing men's and woman's shoes which comprises:

a plurality of shelf angles, each shelf angle being elongated rectangular panels, one panel joined to said other panel at an angle along common elongated edges of said one panel and said other panel;

a vertical support panel;

said support panel secured to said common edges of panels of each shelf angle, one panel of each shelf angle on one side of said support panel and another panel of each shelf angle on an opposite side of said support panel;

means engaging a lower edge of said support panel for supporting said support panel in a vertical position on a horizontal surface;

four corner posts, one corner post connected to a corner of each said shelf angle respectively and adapted to be oriented vertically and for supporting said plurality of shelf angles on said horizontal surface, and supporting one shelf angle above another shelf angle, beginning with a lowest shelf angle, each said shelf angle being convex toward said horizontal surface;

each said shelf angle having an elongated bar member extending from a location proximal to an outside corner of one panel to an outside corner of said other panel, said bar member being perpendicular to said common edges;

said bar member being configured to engage a heel of a shoe having a high heel.

2. A rack as in claim 1 wherein said means engaging a lower edge is a lazy suzan.

3. A rack as in claim 2 wherein said means engaging a lower edge is a floor panel.

4. A rack as in claim 1 wherein said support panel has an opening adapted to be grasped by a user to lift said rack, said opening located proximal to an upper edge opposite said common edge.

5. A rack as in claim 1 wherein said at least one elongated bar member is a pair of parallel horizontal rods, each rod having one end attached proximal to one corner of one panel and another end attached to corner of said other panel of said respective shelf angle said rods being parallel to said common edges and positioned in operable combination with said respective shelf angle to permit hanging shoes with high heels over said parallel rods.

6. A rack as in claim 1 wherein said common edges of said panels are hinged to said vertical support panel.

7. A rack as in claim 6 wherein said at least one elongated bar member is one bar member having two bar sections, each hinged together on one end and one bar section hinged at another end to one corner post and said other bar section having another end hinged to an adjacent corner posts such that said bar sections and panels are enabled to be folded toward said vertical support.

8. A rack for storing men's and women's shoes which comprises:

a plurality of shelf angles, each shelf angle being two elongated rectangular panels, one panel joined to said other panel at an angle along common elongated edges of said one panel and said other panel;

a plurality of legs, four legs for each shelf angle, each leg having an upper end attached to one corner respectively of said shelf angle respectively and extending substantially vertically downward and having a lower end engaging a corner of said lower shelf angle with lowest strip legs attached to said lowest shelf angle adapted for contacting a horizontal surface;

each said shelf angle having an elongated bar member extending from a location proximal to an outside corner of one said panel to an outside corner of said other panel, said bar member being perpendicular to said common edges;

said bar member being configured to engage a heel of a shoe having a high heel.

9. A rack as in claim 8 wherein each said leg comprises:

an elongated strip having a top section with an edge attached to an edge of said corner along said side edge of said panel;

a second section extending vertically downward; and each said leg having at least one notch and each said panel having a notch, said notches arranged in operable combination with one another such that a lower end of said leg is enabled to be snapped into a corner of a lower shelf angle with said notches engaging one another.

10. A rack as in claim 8 comprising:

said at least one elongated bar member is an elongated rigid first strap with a strap surface parallel to said horizontal surface;

said strap surface having a plurality of holes, each hole operably adapted for receiving a heel of a shoe with high heels.

11. A rack as in claim 10 wherein said elongated bar member further comprises a second elongated rigid strap joined with said first strap to form an elongated angle with said strap surface parallel to said horizontal surface.

12. A rack as in claim 11 comprising:

said elongated angle member having a pair of notches, one of said notches in one end and said other notch in another end of said elongated angle member;

said legs extending opposite ends of a side edge of said shelf angle having a notch in each leg;

said notches, one in each leg and said notches in said elongated angle member arranged in operable combination with one another such as to secure said angle member with one end engaged with one leg and another end engaged with an adjacent leg in said other panel.

13. A blank for forming a shelf angle, each said shelf angle useful for forming one shelf of a stack of shelves, said blank comprising:

a rectangular panel having a first edge opposite a second edge and a third edge opposite a fourth edge, said third and fourth edges being perpendicular to said first and second edges;

a first slot parallel to and spaced a distance from said first edge and a second slot parallel to and spaced a distance from said second edge such as to define a first strip parallel to and along said first edge and a second strip parallel to and along said second edge;

a first cut through said first strip and a second cut through said second strip both first and second cuts intermediate said third and fourth edges thereby defining four legs, each leg having a free end and a leg end attached to said panel at a corner of said panel respectively;

a notch in each leg perpendicular to said respective each leg and proximal to said free end respectively and a notch in each corner of said blank such that when said panel is bent along a line parallel to said third and fourth edges thereby forming a shelf angle, one shelf angle is enabled to be securely mounted on top of another shelf angle with a notch in each free end engaging said notch in a corner of said another shelf angle.

14. A blank as in claim 13 which comprises:

said blank having a central bend along a line parallel to said third and fourth edges thereby forming a shelf angle;

said blank having four leg bends, one leg bend located at each corner of said shelf angle respectively such that said four legs are parallel to one another and extending from said shelf angle such that one shelf angle is enabled to be securely mounted on top of another shelf angle with a slot in each free end engaging one of said slots in a respective corner of said another shelf angle.

15. A blank as in claim 14 which comprises at least one elongated first strap having a surface with a plurality of holes, each hole adapted for receiving a heel of a shoe with a high heel and a first pair of slots, one slot of said first pair of slots located proximal to one end of said strap respectively and a second pair of slots, one slot of said second pair of slots located in one said leg and another slot of said second pair of slots such that each one of said first pait of slots is enabled to engage a one slot of said second pair of slots and thereby extend from one leg to said other leg along a side edge of said shelf angle perpendicular to said central bend.

16. A blank as in claim 15 wherein said first strap of said at least one elongated first strap is joined to a second strap such as to form a rigid angle.

17. A blank as in claim 13 wherein said blank is made of a thermoplastic.

* * * * *